US007607267B2

(12) United States Patent
Fulton et al.

(10) Patent No.: US 7,607,267 B2
(45) Date of Patent: Oct. 27, 2009

(54) APPARATUS FOR VENTING OF PROTECTIVE PANELS

(75) Inventors: Rodney Fulton, Fairfield, IA (US); William Hickey, Fairfield, IA (US); Ronald Bovard, Fairfield, IA (US); Robert Greco, Fairfield, IA (US); Rene' Holmberg, Birmingham, IA (US); Paul Conley, Birmingham, IA (US); Clint Kobelt, Bonaparte, IA (US)

(73) Assignee: Bovard Studio, Inc, Fairfield, IA (US)

( * ) Notice: Subject to any disclaimer, the term of this patent is extended or adjusted under 35 U.S.C. 154(b) by 589 days.

(21) Appl. No.: 10/679,072

(22) Filed: Oct. 3, 2003

(65) Prior Publication Data

US 2005/0072076 A1 Apr. 7, 2005

Related U.S. Application Data

(60) Provisional application No. 60/416,310, filed on Oct. 4, 2002.

(51) Int. Cl.

| | |
|---|---|
| ***E06B 3/66*** | (2006.01) |
| ***E06B 7/14*** | (2006.01) |
| ***E04B 1/70*** | (2006.01) |
| ***A47L 1/16*** | (2006.01) |

(52) U.S. Cl. ..... 52/209; 52/204.59; 52/302.1; 454/198

(58) Field of Classification Search ..... 52/203, 52/209, 786.1, 311, 204.59, 302.1; 49/501; 454/196, 198, 200, 211

See application file for complete search history.

(56) References Cited

U.S. PATENT DOCUMENTS

| | | | | |
|---|---|---|---|---|
| 217,630 | A * | 7/1879 | Maull | 454/211 |
| 4,627,206 | A * | 12/1986 | Cox | 52/209 |
| 4,656,803 | A * | 4/1987 | Chludil | 52/209 |
| 5,279,086 | A * | 1/1994 | Liao | 52/212 |
| 5,299,399 | A * | 4/1994 | Baier et al. | 52/204.52 |
| 5,993,925 | A * | 11/1999 | Zoccole | 428/38 |
| 6,357,186 | B1 * | 3/2002 | Gould | 52/209 |
| 6,374,557 | B1 * | 4/2002 | O'Donnell | 52/209 |

OTHER PUBLICATIONS

Clem Labine, Storm Windows:Avoiding The Moisture Trap, Sep./Oct. 1991, vol. 4/No. 5, Traditional Building, Brooklyn, NY.

Ron Bovard, Preserve Your Stained Glass Heritage, May 2003, Conference For Catholic Facility Management.

Ron Bovard, Stained-Glass Protection, Dec. 2005, vol. 18/ No. 6 Traditional Building, Brooklyn, NY.

Inspired Partnerships, Inc., Protective Glazing Study, Jun. 30, 1996, National Preservation Center, Nachitoches, LA.

* cited by examiner

*Primary Examiner*—Richard E Chilcot, Jr.
*Assistant Examiner*—Ryan D Kwiecinski
(74) *Attorney, Agent, or Firm*—Camille L. Urban; G. Brian Pingel

(57) ABSTRACT

The present invention provides an apparatus for venting an airspace formed between an ornamental window and a protective panel. The venting means includes at least one pair of vent openings, one for air to enter the airspace and one for air to exit. These vent openings include a path through the frame holding the protective panel to an interior opening which is to the airspace. The vent openings, the paths and the interior openings must be of adequate size to minimize the range of temperature and moisture within the airspace. It is recommended that effective vent openings are at least one square inch for every 2000-2500 square inches of ornamental window.

21 Claims, 8 Drawing Sheets

APPARATUS FOR VENTING OF PROTECTIVE PANELS

This application claims the benefit of U.S. Provisional Application No. 60/416,310 filed Oct. 4, 2002.

BACKGROUND OF THE INVENTION

1. Field of the Invention

The present invention relates in general to providing means for adequate ventilation for protective panels or covers used for protecting ornamental windows such as stained glass.

2. Description of the Prior Art

Ornamental windows, such as stained glass windows, represent an expensive investment for an individual or institution. These windows are typically on the exterior of buildings and as such are exposed to moisture, wind, excessive heat and vandalism. Repair of such windows can represent an enormous expense.

It is therefore common to employ protective panels for such windows, to not only protect the ornamental window from damage, but to provide an insulating or thermal barrier for the ornamental window. A protective covering is described in U.S. Pat. No. 5,993,925. Typically these protective coverings which are sometimes referred to as protective glazing, cover the ornamental window pattern in such a fashion that it corresponds to the window's geometric shape. These protective coverings or panels can comprise a wide diversity of transparent materials such as clear or tempered glass, acrylic, polycarbonate, as well as laminated or thermopane glass. These panels typically provide an airspace between the panel and ornamental window to provide a thermal barrier.

Unfortunately, the use of these panels often actually results in unintended and accelerated damage. It is not uncommon for these panels to be added without adequate ventilation. This allows the airspace created between the panel and window to cycle between superheated high temperatures and low temperatures relative to sun exposure. This constant cycling between high and low temperature in the airspace damages leaded stained glass windows by metal fatigue which weakens the leaded seams between the glass sections of the stained glass window. Moisture that may also inadvertently be trapped in the airspace represents a threat to the stained glass appearance, allows bacteria and microorganisms to multiply and damage the cemented portions, and accelerates the deterioration of the leaded joint. Non vented protective panels act as a solar box, cycling temperatures between 165 and 5 degrees Fahrrenheit and leaving the temperature at or near dewpoint for longer periods of time than would otherwise occur. Because of the various materials in the window i.e. glass, lead, wood and their respective and varied expansion coefficients, this temperature swing over time weakens the structure allowing bowing, weakening, and cracking.

It is therefore common for installers of these protective panels to drill holes in portions of the panel to provide some degree of air exchange with the exterior air. These holes however, reduce the aesthetic value of the protective panel and, for the most part, do not provide an adequate source of ventilation for the airspace. In addition, without some sort of filter device, these holes allow moisture, insects and debris to enter the space between the stained glass window and the protective panel. Therefore, this kind of ventilation does not address the problems posed by heat cycling and moisture between the protective panel and the window.

It is therefore an object of the present invention to provide a means for the ventilation of protective panels for ornamental windows that provides an adequate degree of air exchange with exterior or interior air, to avoid or at least minimize the problems posed by heat cycling and trapped moisture.

It is also an object of the present invention to provide venting means for the airspace between the protective panel and the ornamental window wherein venting means are included in the frame to avoid appearance issues with the cover.

It is a further object to provide venting means which provide directed air flow or air exchange in the airspace.

It is an object to provide venting means which may be included in the frame holding the protective panel and the stained glass window or in a perimeter frame holding just the protective paneling or in other frame elements such as mullions or muntins.

It is an objective of the present invention to provide venting means which adequately prevent moisture in the form of rain water and insects from entry.

These and other objects are achieved by the present invention described below.

SUMMARY

The present invention discloses an apparatus whereby adequate ventilation is provided between a protective panel and an ornamental window such as a stained glass window. This is achieved by providing venting means, preferably comprising at least one entry vent and an exit vent for each entry vent, said vents being of specific dimensions relative to those of the ornamental window. The venting means provide a way for exterior or interior air to circulate between the protective panel and the ornamental window itself and provide directed air flow in the air space between the panel and window. The direction of the airflow is a result of the air warming upon entry and then rising. The vent openings that are included in said venting means in the frame are connected to reach the airspace between the panel and window. A preferred and typical embodiment of the present invention is to use vent openings in pairs in the frame to provide points of entry and exit, for either interior or exterior air, thereby directing air flow through the air space in such a manner to provide more effective air circulation.

The vent openings of the venting means must be of an adequate size so that effective air circulation in the space is achieved thereby minimizing heat or moisture damage to said ornamental window. Specifically there is recommended at least about 1 square inch of 100% effective vent opening, both entry and exit, for about 2000-2500 square inches of stained glass. Openings for vents that are screened are usually around 60% effective. Therefore, for every square inch of 100% effective open vent required, about 1.67 square inches of screened vents should be used. The effective level depends on screen density and is similarly altered by a ceramic filter, a hood, or any other debris deterring accessory. The present invention meets the objectives stated previously because it meets the general requirements for providing effective openings per area of stained glass and adequately provides airflow between the protective panel and the stained glass. Due to adequate airflow, moisture is removed more quickly, the temperature does not hover near dewpoint for long periods of time creating interior condensation, and the temperature cycles in the range of 35 to 105 degrees Fahrenheit rather than the broader range of 5 to 165 degrees which is typical of inadequately vented panels.

In the preferred embodiment of the present invention, the vent openings of said venting means include a screen to deter insects, debris and water and the vent size used takes into account the effect of the screen density or other air filtering devices that influence air flow, as well as the cross sectional areas of any passages or openings through which the air will flow. In the preferred embodiment, the venting means include a vertical portion of a passageway which acts to prevent rainwater from entering the air space between the protective panel and the window.

It is not uncommon in ornamental window design that mullions or muntins are included. A mullion is the vertical element that separates the lancets of a window whereas a muntin is usually a horizontal element that separates or divides glass. These elements are included for geometric appeal and it is equally apparent that in such windows, venting means of the present invention can also be included in these mullions or muntins, provided that they are connected with the inner airspace between the panel and window.

In one modification of the preferred embodiment, venting means are included in a frame which holds both the protective panel and the stained glass window. The venting means facilitate entry and exit of air flow in airspaces created between the stained glass, the protective panel, and the frame boundaries. Venting means can also be positioned in the mullions or muntons as described above. In the preferred embodiment, venting means comprise vent openings the sizes of which are governed by the same mathematical relationship as previously described to achieve adequate and efficient air flow.

In a second modification of the preferred embodiment, the protective panel is placed in a perimeter frame which is spaced apart from the original stained glass and its structural components. Venting means are included in the perimeter frame thereby bypassing the need for vents in mullions or muntons.

In a third modification of the preferred embodiment, venting means are positioned in a frame which is a replica of the appearance of the original frame so that the aesthetic appearance is preserved while providing adequate venting.

In a fourth modification of the preferred embodiment, venting means are positioned in a casting comprising a vent opening, a path with a cross sectional area, a proximal path, an inside opening, a distal path, and an interior opening, and a closed top end. Each casting is then positioned in a frame as needed for venting purposes. In a situation where it is desired to preserve the original frame, the original frame may be altered such that its ornamental surface remains intact and the casting may be placed behind its ornamental surface with only an appropriate vent opening cut in the ornamental surface of the frame.

Other objects, features, and advantages of the present invention will be readily appreciated from the following description. The description makes reference to the accompanying drawings, which are provided for illustration of the preferred embodiment. However, such embodiment does not represent the full scope of the invention. For example, entry vent openings and exit vent openings may be placed anywhere in the frame as long as an exit vent opening is vertically above the vertical position of an entry vent openings. The subject matter which the inventor does regard as his invention is particularly pointed out and distinctly claimed in the claims at the conclusion of this specification.

DESCRIPTION OF THE PREFERRED EMBODIMENT(S)

Figure 1:
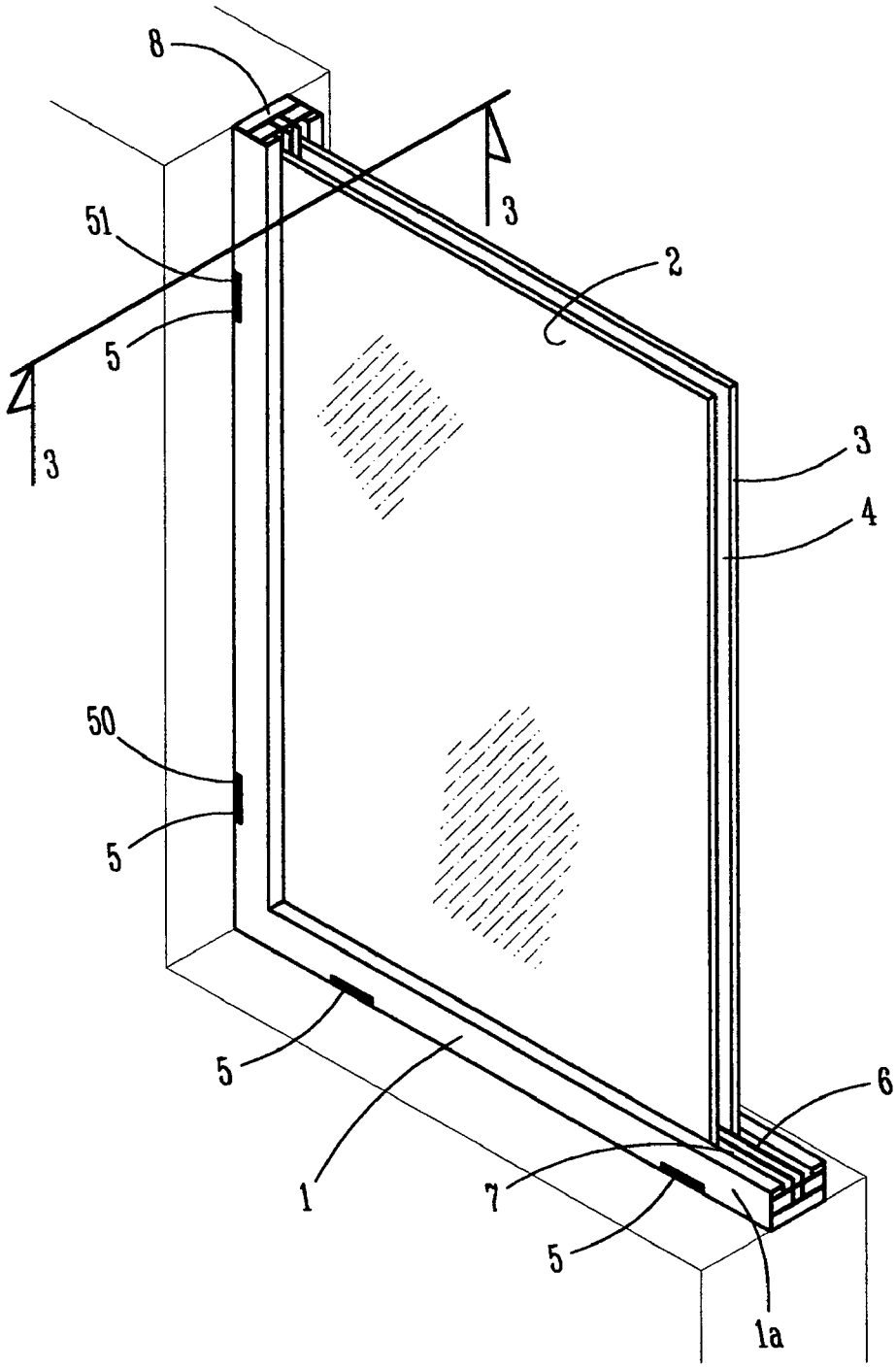
FIG. 1 represents a front elevational view of a first modification of the preferred embodiment of the venting apparatus incorporated in a total frame holding both a protective panel and an ornamental window.
Figure 2:
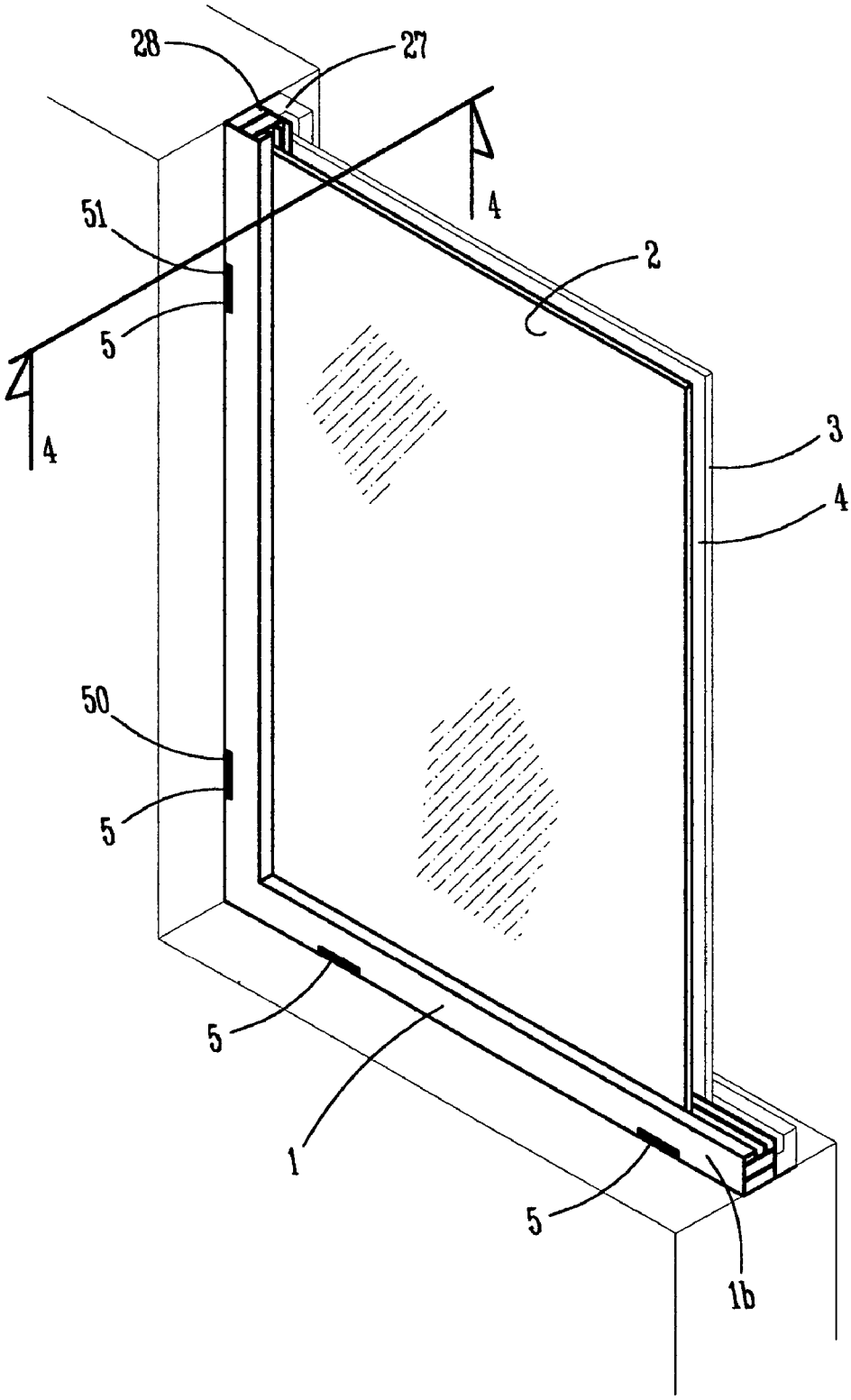
FIG. 2 represents a front elevational view of a second modification of the preferred embodiment of the venting apparatus incorporated in a perimeter frame holding a protective panel for ornamental windows.
Figure 3:
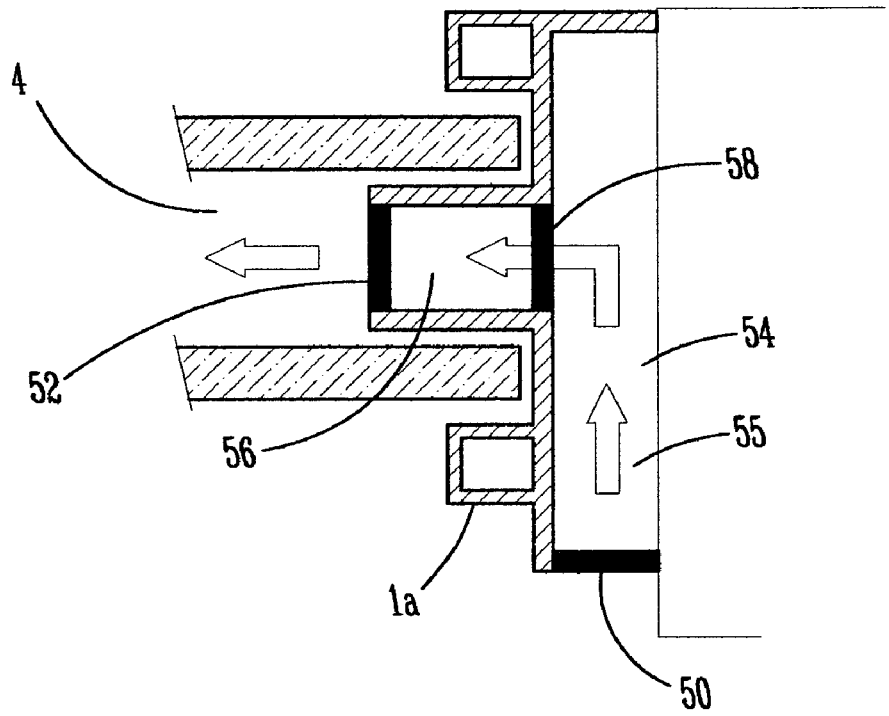
FIG. 3 shows a cross section of the modification shown in FIG. 1 along line 3-3 illustrating a connection between an entry vent opening and an airspace between the panel and window.
Figure 4:
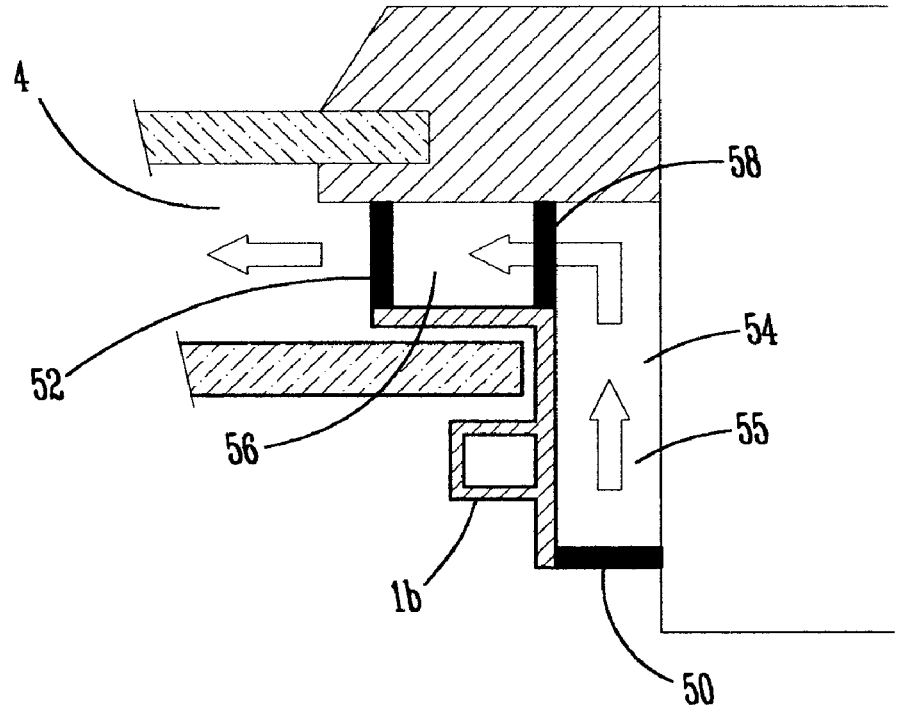
FIG. 4 shows a cross section of the modification shown in FIG. 2 along line 4-4.
Figure 5:
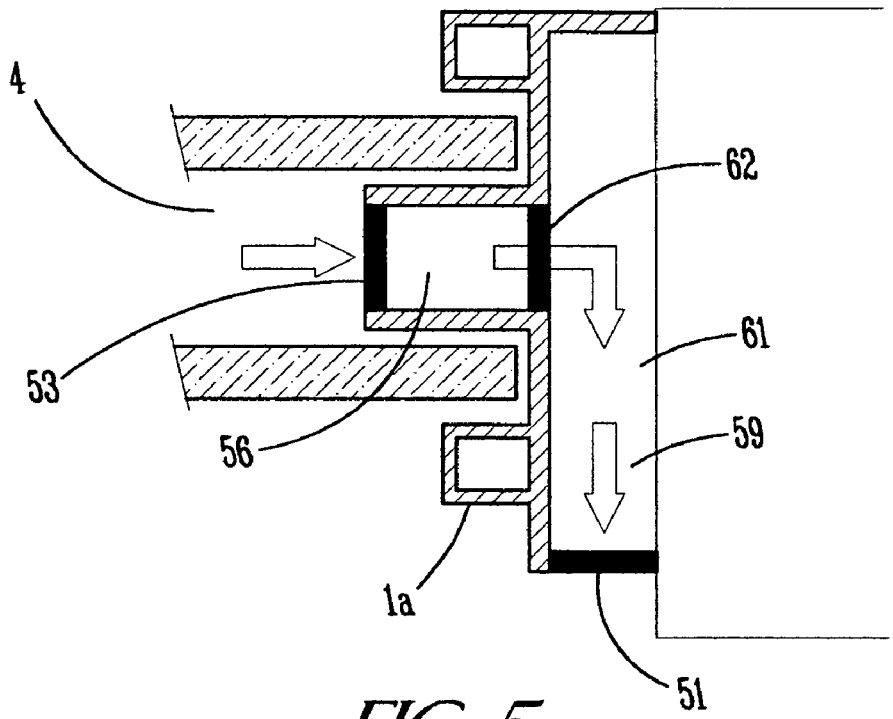
FIG. 5 shows a cross section of the modification of FIG. 1 along line 5-5 illustrating a connection between an exit vent and the airspace.
Figure 6:
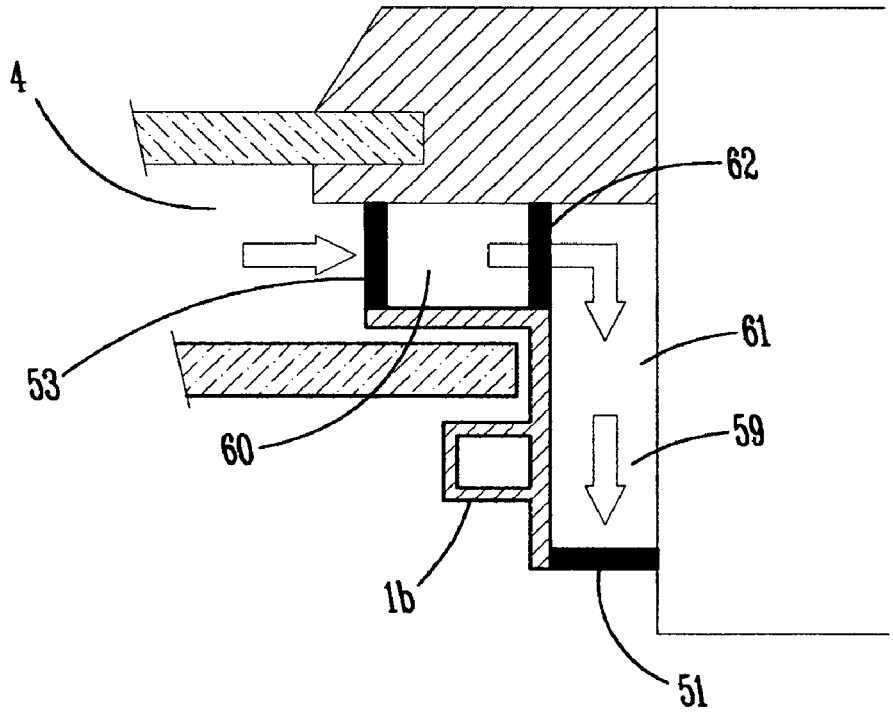
FIG. 6 shows a cross section of the modification of FIG. 2 along line 6-6 illustrating a connection between an exit vent and the airspace.
Figure 7:
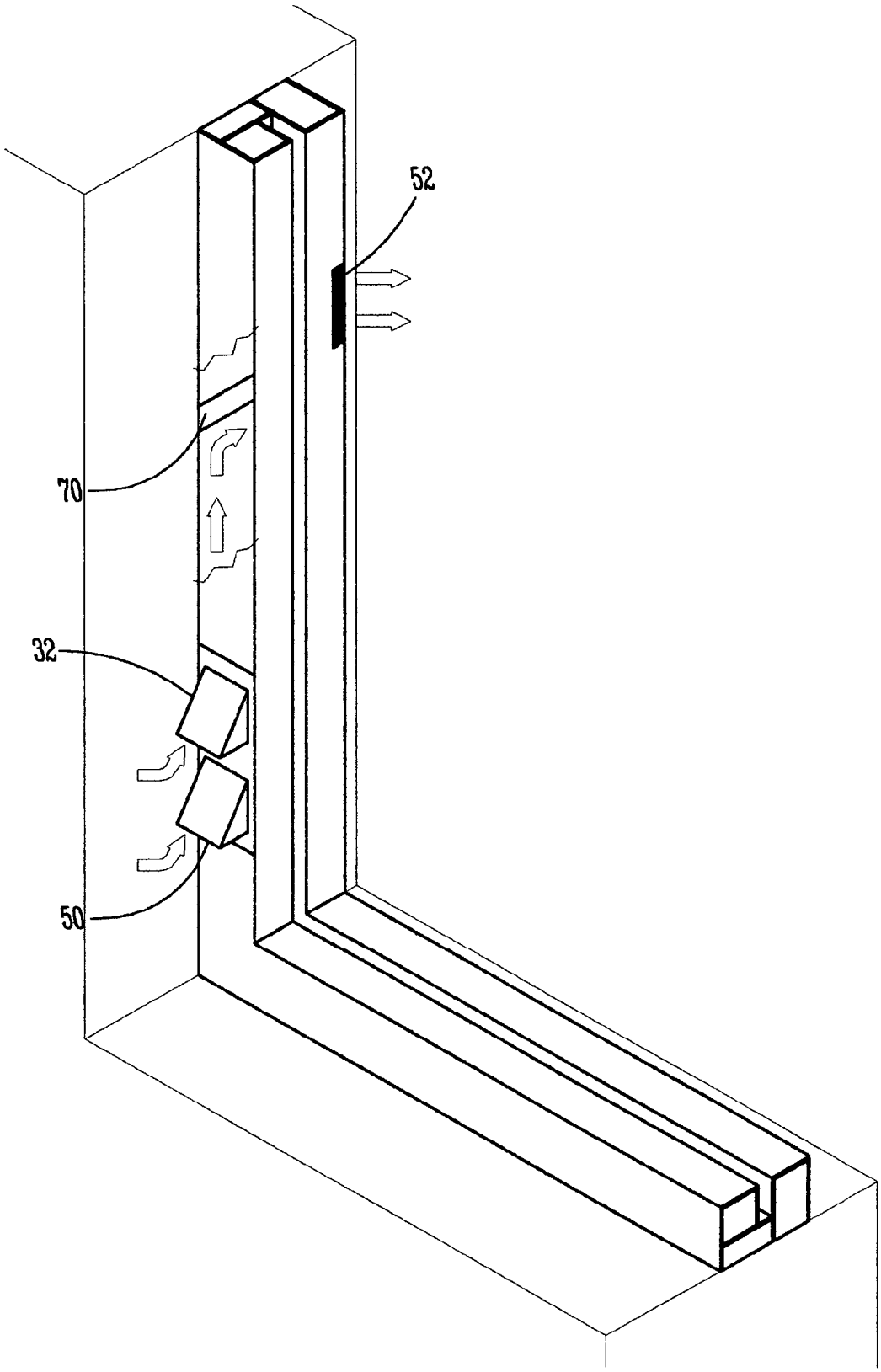
FIG. 7 is a schematic showing the path of airflow through said venting means.

The preferred embodiment of the present invention is shown generally in two modifications in FIGS. 1 and 2 and includes the elements of an ornamental window 3, a protective panel 2, a framing element 1, an airspace 4, and carefully crafted venting means 5. Specifically, FIG. 1 shows a first modification of the preferred embodiment of the present invention which is a protective panel 2 over an ornamental window, such as a stained glass window 3, in a total frame 1*a*. An airspace 4 between said protective panel 2 and said stained glass window 3 is provided by the placement of the panel 2 and the window 3 in the total frame 1*a*. Venting means 5 will be described in full detail below.

The total frame 1*a* of the first modification of the preferred embodiment comprises side channels 6 and 7 for the panel 2 and ornamental window 3 to be inserted. It is not uncommon for total frame 1*a* to comprise an extruded aluminum frame, however, it is not so limited. Extruded aluminum frames often include a thermal barrier or thermo break 8 behind the airspace 4. The thermal break 8 can comprise polyurethane or any other suitable synthetic or natural insulating material and is adjacent to and abuts the back of the airspace 4.

In a second modification of the preferred embodiment, the protective panel 2 is mounted in a perimeter frame 1*b*.

Said airspace 4 is provided by a separation 28 of said ornamental window 3 and the panel 2 which results from placement of the perimeter frame 1*b* relative to a window frame 27. Venting means 5 are crafted according to specifications described more fully below.

In each modification, and shown best in FIGS. 3-7, venting means 5 preferably comprise vent openings 50 and 51 which occur in pairs, one for entry (50) and one for exit (51) of air thereby providing air flow through air space 4 in a directional manner. Entry vent openings 50 each further comprise a first path 54 and a first interior vent opening 52. In the preferred embodiment, said first path 54 comprises a first proximal path 55 and a first distal path 56 separated by a first inside opening 58 between said entry vent opening 50 and said first interior vent opening 52. Exit vent opening 51, in like fashion, comprises a second path 59 and a second interior vent opening 53 and, in the preferred embodiment, said second path 59 comprises a second proximal path 60 and a second distal path 61 separated by a second inside opening 62. Said first interior vent opening 52 is preferably above said entry vent opening 50 so that rain water does not pass from the entry vent opening 50 to the airspace 4. Air flow direction is dictated by the principle that heat rises drawing warm air upward. Placement of venting means 5 are preferably in vertical portions of frames 1*a* or 1*b* for aesthetic appeal as well as for maintaining the strength and integrity of the frames, however, placement in horizontal portions is also contemplated. It is contemplated that a debris deterring accessory 32 such as a screen, hood, or ceramic filter may be installed over said entry vent opening to deter entry of bugs and debris. Finally, there is no limit to the number of vent openings employed, however, it is recommended that there is an entry vent opening 50 present for every exit vent opening 51.

Said entry vent opening 50 has a first area, said exit vent opening 51 has a second area said first interior opening 52 has a third area and said second interior opening 53 has a fourth area. Said first path 54 has a first cross sectional area and said first proximal path 55 comprises a first proximal cross sectional area and said first distal path 56 includes a first distal cross sectional area. Said first inside opening 58 comprises a fifth area. Said second path 59 comprises a second cross sectional area and said second proximal path 60 includes a second proximal cross section. Said second distal path 61 includes a second distal cross section and said second inside opening 62 comprises a sixth area.

To obtain adequate venting, it is recommended that said first area of the entry vent opening 50, said third area of the interior vent opening 52, and said first cross sectional area of the first path 54 are related as described below. This recommendation applies equally to the fourth area of the interior vent opening 53 and the second cross sectional area of the second path 59 and the second area of the exit vent opening 51.

Two simple principles provide guidelines as to the relative areas of vent openings. First, to provide adequate venting means, at least about 1 square inch of 100% effective opening to the air should be present for each about 2000 to 2500 square inches of the area of the ornamental window. Second, the first area of the entry vent 50, the first cross sectional area of the first path 54, and the area of the first interior vent 52 will provide adequate venting when they are related such that air flowing into said first path 54 is not constricted in its movement to the airspace 4. Expressed mathematically, this relationship can be understood as:

First area > or equal to first cross sectional area < or equal to third area; and Fourth area > or equal to second cross sectional area < or equal to second area It should also be understood that, depending on the positioning of said venting means, said first inside opening 58 and the fifth area may not be of equal dimension as said entry vent opening 50 and the first area. In that situation, the air must flow between said entry vent opening 50 and said interior vent opening 52 through said first inside opening 58. When this is the case, the fifth area (which is the area of said first inside opening) should be equal to or greater than the first proximal cross sectional area and the first distal cross sectional area in order to meet the principle requiring no constriction. This same logic applies relative to said exit vent opening 51, said second interior vent opening 53, and said second inside opening 62.

If said entry vent 50 is provided deterring accessories such as screens, filters, or hoods, then the effectiveness of that opening will be reduced. For example, an entry vent with a screen may have an effective level of 66%. Therefore, a screened entry vent should be 1.67 times larger than one without in order to provide an equal amount of effective ventilation. Considering the equation above, then, $$(\text{effective } 50a) = 66\% \times \text{area of unobstructed opening}$$

Venting means may be positioned directly in frame 1*a* or 1*b* by cutting said entry vent opening in a portion of said frame 1*a* or 1*b*, incorporating a normally hollow interior of said frame as said first path 54, and cutting said first interior vent 52 in same said frame such that said first interior vent 52 is open to said first path 54 and to said airspace 4 between said protective panel 2 and said ornamental window 3. It is contemplated that frame 1*a* or 1*b* may be of extruded aluminum but it is not so limited. Many frames of extruded aluminum include thermo breaks 8. In that case, said first path 54 would include said first inside opening 58 cut in said thermo break 8 to provide a way for air to move from said entry vent opening 50 through said first interior vent 52. A screen 33 may be added as a debris deterring accessory to said entry vent opening to provide protection from insects and debris. If needed, a second entry vent opening 50 may be closely and vertically spaced from said entry vent opening in order to achieve adequate venting and still maintain the structural integrity of said frame 1*a* or 1*b*. Finally, in some climates it may be advisable to provide a hood 32 over said entry vent 50 to minimize inflow of rain. In addition, at least one dam member 70 can be installed above and below said entry vent opening 50 to provide upper and lower boundaries for said first path 54 in order to prevent said frame 1*a* or 1*b* from acting as a chimney drawing air up into the frame rather than through said first path 54 and out said first interior vent opening 52 to said airspace 4.

Venting means 5 is completed by positioning said exit vent opening 51 directly in said frame 1*a* or 1*b* vertically spaced apart from said entry vent opening 50. Said second interior opening 53 is positioned in said frame to allow inflow of air to said second path 59 and through said exit vent opening 51. Because of the direction of air flow through said exit vent opening 51, no dam member 70 is necessary.

Figure 8:
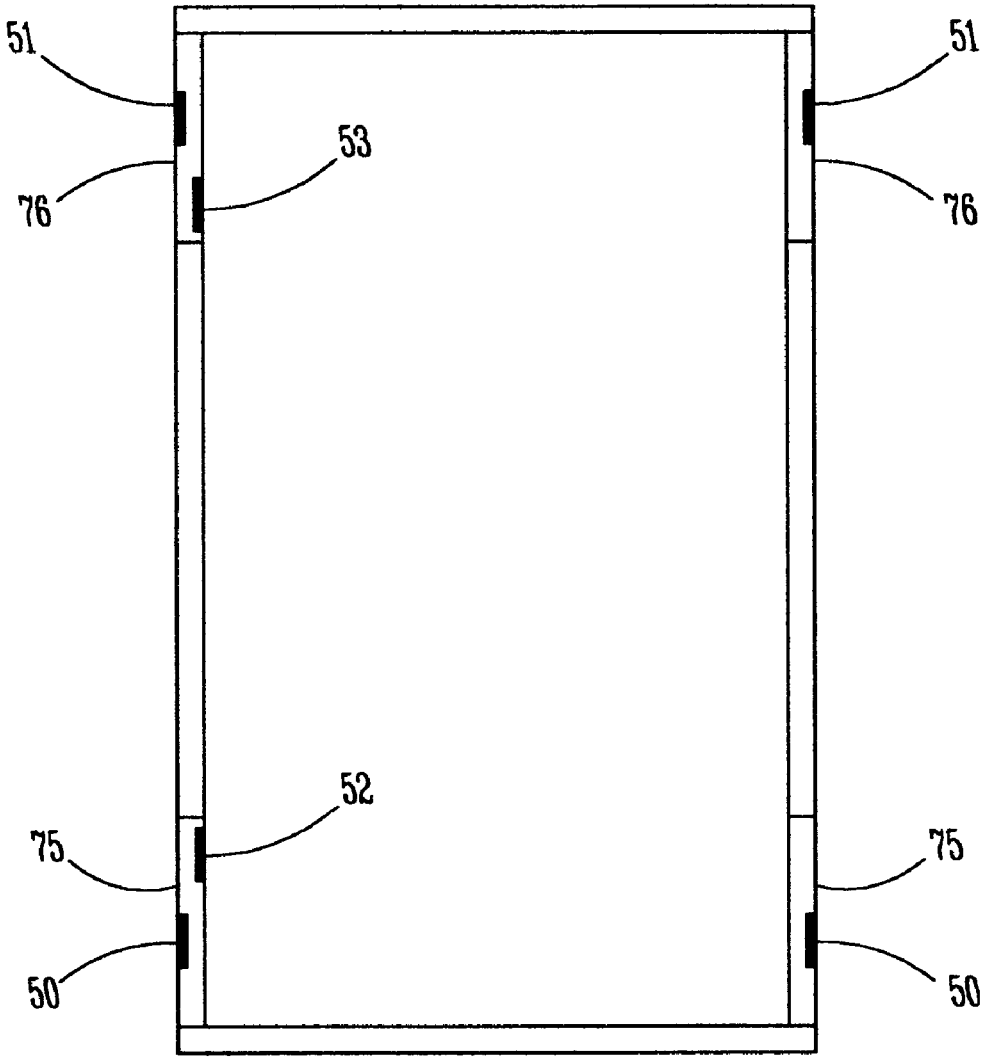
FIG. 8 shows a front plan view of a frame containing castings of the fourth modification of the preferred embodiment of the venting means.

Venting means 5 may instead be fully incorporated in two castings each having a closed top end 80. In this situation, a first casting 75 comprises an entry vent opening 50, a first path 54, and a first interior opening 52. Said closed top end 80 eliminates any need for said dam member 70 described above. Said screen 32 and said hood 33 may be employed with the same effect as described above. A second casting 76 comprising an exit vent opening 51, a second path 59, and a second interior opening 53 would be positioned above said first casting 75 and both said castings would be incorporated in said frame (See FIG. 8). The preferred recommended mathematical relationships between vent openings, areas and cross sections remains the same for effective venting and, as in the description above, if there is present said second inside opening or said first inside opening, the fifth and sixth areas should be considered in the equation relative to said first and second proximal cross sections, respectively, and said first and second distal cross sections, respectively.

Figure 9:
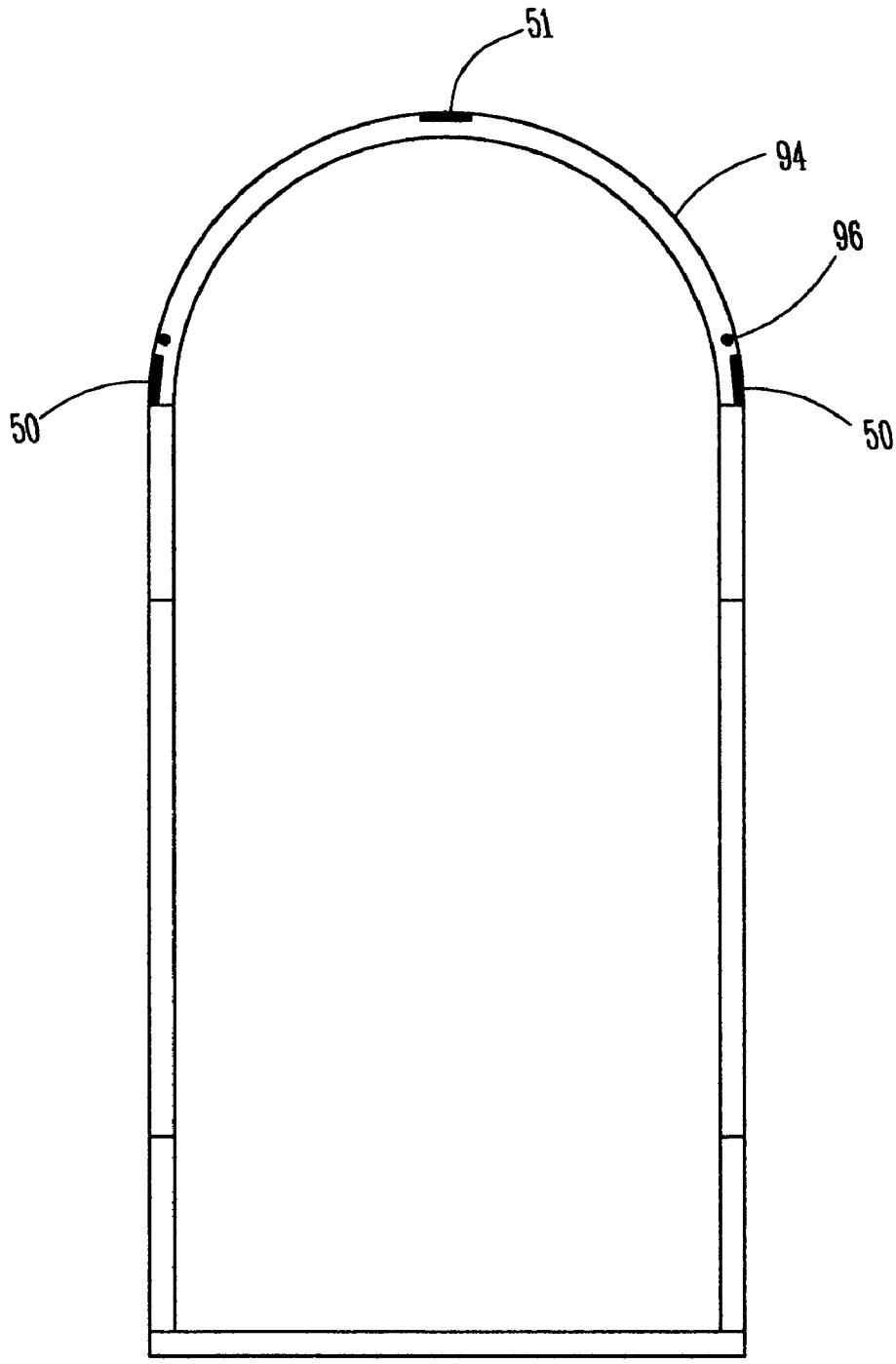
FIG. 9 shows a front plan view of a frame with a round top and containing venting means of the present invention.
Figure 10:
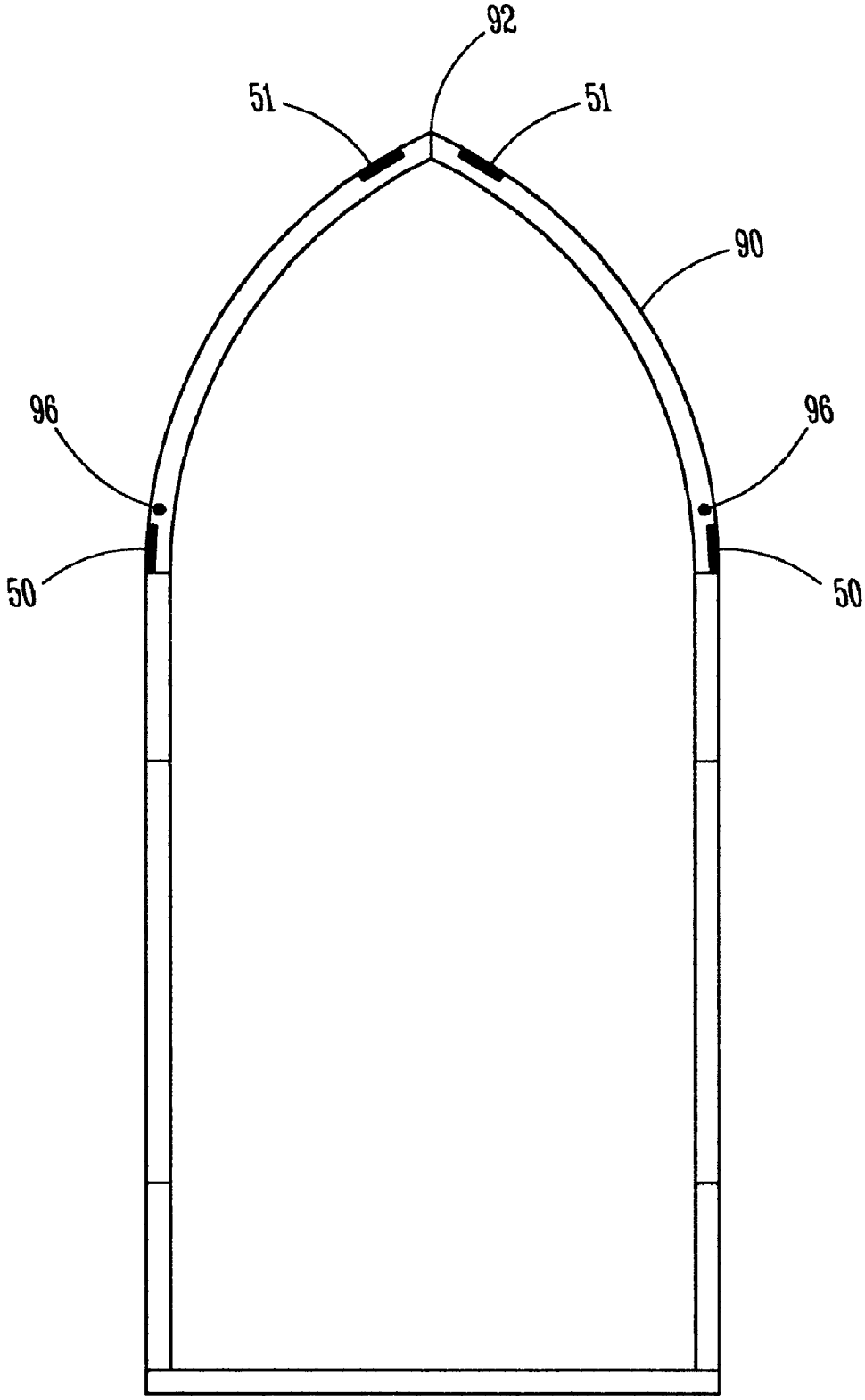
FIG. 10 shows a front plan of a frame with a gothic top and containing venting means of the present invention.

Referring now to FIGS. 9 and 10, many ornamental windows and their frames have a gothic top portion 90 with an apex 92, or rounded 94 top portions. The venting means 5 of the present invention can be employed to provide adequate venting for windows with these characteristics as well. In these constructions, at least one said entry vent opening 50 is positioned in a lower portion of said gothic top portion 90 or said rounded top portion 94. In said gothic top portion 90, at least one exit vent opening 51 is placed near said apex 92 which typically results in a 30 degree angle with horizontal. Said exit vent opening 51 is of slightly narrower proportions than those previously discussed and is cut from an outermost edge of said frame. This orientation allows said venting means 5 to function essentially as horizontal venting means. In said round top version, at least one exit vent opening 51 is placed near an uppermost curved portion. In either a round top or gothic top installation said frames have an interior surface. At least one weep hole 96 is positioned above and proximal to said entry vent 51 and said interior surface is wetted to assist in directing any water that enters down to said weep hole 96. The mathematical relationship of areas of openings and cross sections in round top and gothic top windows should also follow the rationale described above.

The material used in frame 1*a* or 1*b* is typically aluminum, but is not so limited and can be made of other types of synthetic or natural material which minimize maintenance problems and are easily installed. Extruded aluminum frames such as that pictured in FIGS. 1 and 2 are most commonly used because of the ease of installation and durability. Wood frames are, however, also used. The protective panel 2 that is employed may also be selected from a wide variety of transparent materials such as glass, including tempered, laminated or thermopane glass, such as double or triple glazed units. Synthetic materials suitable for use as a protective panel in the present invention include acrylic, or polycarbonate panels. The present invention is not intended to be limited by the specific material used for either the frame or protective panel. Finally, the air exchange facilitated by venting means of the present invention is not limited to exchange with air exterior to the building in which the window is installed. The exchange may be with air interior to the building which, in some climates such as the southernmost United States, is more advantageous for managing moisture and heat damage.

Thus, the present invention has been described in an illustrative manner. It is to be understood that the terminology that has been used is intended to be in the nature of words of description rather than of limitation.

Many modifications and variations of the present invention are possible in light of the above teachings and some have been presented herein. Therefore, within the scope of the appended claims, the present invention may be practiced otherwise than as specifically described.

We claim:

1. An apparatus for venting ornamental windows covered by a protective panel comprising:

a) stained glass window;

b) a protective panel;

c) a framing element;

d) at least one airspace between said window and said protective panel;

e) venting means comprising an entry vent opening on the outside of the apparatus and an exit vent opening vertically spaced above and on the outside of the apparatus;

f) said entry vent opening comprising a first path causing a first directional turn upwards and a first interior vent opening vertically spaced above said entry vent opening and causing a second directional turn in a horizontal direction to said airspace, and said exit vent opening comprising a second path causing a first directional turn and a second interior vent opening vertically spaced below said exit vent opening and causing a second directional turn to said airspace for facilitating upwards airflow in said airspace.

2. the apparatus for venting ornamental windows as claimed in claim 1 wherein each said entry vent opening further comprises a first area, said exit vent opening further comprises a second area; said first interior vent opening comprises a third area and said second interior vent opening comprises a fourth area; said first path comprises a first cross sectional area; said second path comprises a second cross sectional area; said first area at least equals said first cross sectional area and said first cross sectional area does not exceed said third area; and said second area at least equals said second cross sectional area and said second cross sectional area does not exceed said fourth area for facilitating adequate rate and volume of airflow.

3. The apparatus for venting ornamental windows as claimed in claim 2 where said first area equals at least one square inch for each about 2000 to 2500 square inches of ornamental window to be vented.

4. The apparatus for venting ornamental windows as claimed in claim 3 wherein said entry vent opening is covered by a screen such that is has an effective first area of 66% such that said first area at least equals 1.66 square inches for each about 2000 to 2500 square inches of ornamental window.

5. The apparatus for venting ornamental windows as claimed in claim 1 wherein said first interior vent opening is spaced vertically above said entry vent opening to prevent entry of rainwater into said air space.

6. An apparatus for venting ornamental windows covered by a protective panel comprising:

a) a stained glass window;

b) a protective panel;

c) a framing element;

d) at least one airspace between said window and said protective panel;

e) venting means comprising a plurality of pairs of vent openings each said pair positioned in a vertical portion of said framing element with an exit vent opening spaced vertically above an entry vent opening, said entry vent opening directly to air outside the apparatus having a first area and said exit vent opening directly to air outside the apparatus having a second area;

f) each said entry vent opening comprises a first path causing a first directional turn upwards and a first interior opening spaced vertically above said entry vent opening and causing a second directional turn in a horizontal direction and each said exit vent opening comprises a second interior opening causing a directional turn and a second path causing a directional turn; and g) for each said entry vent opening, said first interior opening comprises a third area and for each said exit vent opening, each said second interior opening comprises a fourth area, each said first path comprises a first cross-sectional area and each said second path comprises a second cross-sectional area.

7. The apparatus for venting ornamental windows as claimed in claim 6 wherein for each said entry vent opening, said first area at least equals first cross sectional area and said first cross sectional area does not exceed said third area and a sum of all said first areas is at least one square inch for every 2000-2500 square inches of ornamental window for facilitating adequate rate and volume of airflow.

8. An apparatus for venting ornamental windows as claimed in claim 7 wherein for each said exit vent opening, said fourth area at least equals said second cross sectional area and said second cross sectional area does not exceed said second area.

9. An apparatus for venting ornamental windows covered by a protective panel comprising:

a) a stained glass window;

b) a protective panel;

c) at least one framing element;

d) at least one airspace between said window and said protective panel;

e) venting means comprising at least one pair of vent openings each pair comprising an entry vent opening having a first area and an exit vent opening having a second area and spaced vertically above said entry vent opening;

f) each said entry vent opening comprises a first proximal path causing a first directional turn upwards and having a first proximal cross section, a first inside opening causing a second directional turn in a horizontal direction, a first distal path having a first distal cross section and a first interior opening vertically spaced above said entry vent opening all for allowing air to flow into said airspace and each said exit vent opening comprises a second proximal path causing a first directional turn and having a second proximal cross section, a second inside opening causing a second directional turn, a second distal path having a second distal cross section and a second interior opening vertically spaced below said exit vent opening all for allowing air to flow out of said airspace;

g) said first interior opening comprises a third area and said second interior opening comprises a fourth area;

h) said first inside opening comprises a fifth area and said second inside opening comprises a sixth area;

i) for each said entry vent opening, said first area does not exceed said first proximal cross sectional area, said fifth area at least equals said first proximal cross sectional area, said first distal cross sectional area at least equals said fifth area, and said third area at least equals said first distal cross sectional area; and j) for each said exit vent opening, said fourth area does not exceed said second distal cross sectional area, said sixth area at least equals said second distal cross sectional area, said second proximal cross sectional area at least equals said sixth area and said second area at least equals said second proximal cross sectional area for facilitating adequate rate and volume of flow to minimize the effects of extreme temperatures and of bacterial damage.

10. The apparatus for venting ornamental windows as claimed in claim 9 wherein at least one dam member is positioned to direct airflow from each said entry vent opening to each said first path.

11. The apparatus for venting ornamental windows as claimed in claim 9 wherein at least one said framing element is a first casting having at least one said entry vent opening and another at least one said framing element is a second casting having at least one said exit vent opening.

12. The apparatus for venting ornamental windows as claimed in claim 9 wherein said at least one framing element is a total frame which holds both said protective panel and said ornamental window.

13. The apparatus for venting ornamental windows as claimed in claim 9 wherein said at least one framing element is a perimeter frame which holds only said protective panel and said airspace is defined by a separation between said protective panel and said ornamental window.

14. The apparatus for venting ornamental windows as claimed in claim 13 wherein said venting means further comprises a first casting having at least one said entry vent opening and a second casting having at least one said exit vent opening.

15. The apparatus for venting ornamental windows as claimed in claim 13 wherein at least one dam member is positioned to direct airflow from each said entry vent opening to each said first path.

16. The apparatus for venting ornamental windows as claimed in claim 13 wherein at least one of said entry vent openings includes a debris deterring accessory.

17. The apparatus for venting ornamental windows as claimed in claim 13 further comprising at least one hood positioned proximal one of said entry vent opening for deterring entry of debris.

18. The apparatus for venting ornamental windows as claimed in claim 13 further comprising at least one screen proximal one of said entry vent opening for deterring entry of debris.

19. The apparatus for venting ornamental windows as claimed in claim 9 wherein at least one of said entry vent openings includes a debris deterring accessory.

20. The apparatus for venting ornamental windows as claimed in claim 19 wherein said debris deterring accessory is a screen.

21. The apparatus for venting ornamental windows as claimed in claim 19 wherein said debris deterring accessory is a hood.

* * * * *